United States Patent [19]

Benkert

[11] 3,982,400

[45] Sept. 28, 1976

[54] DISTRIBUTION VALVE FOR IRRIGATION CHANNELS

[76] Inventor: Donald E. Benkert, 999 E. Valley Blvd., Unit No. 50, Alhambra, Calif. 90032

[22] Filed: Nov. 24, 1975

[21] Appl. No.: 634,371

[52] U.S. Cl. ..... 61/24; 61/22 A; 251/61

[51] Int. Cl.[2] ..... E02B 7/40

[58] Field of Search ..... 61/28, 29, 22, 22 A, 61/24, 23; 251/61, 63, 300, 326, 328, 329

[56] References Cited

UNITED STATES PATENTS

| | | | |
|---|---|---|---|
| 1,334,354 | 3/1920 | Dodd | 61/24 UX |
| 1,597,371 | 8/1926 | Gfeller | 61/22 R X |
| 1,738,051 | 12/1929 | Harker | 61/23 |
| 3,588,036 | 6/1971 | Harter | 251/61 |
| 3,945,565 | 3/1976 | Lynch et al. | 251/61 X |

FOREIGN PATENTS OR APPLICATIONS

| | | | |
|---|---|---|---|
| 783,173 | 7/1935 | France | 61/23 |

*Primary Examiner*—Dennis L. Taylor
*Attorney, Agent, or Firm*—Wm. Jacquet Gribble

[57] ABSTRACT

One or more domed valve closure members are operable to open and close ports in the side walls of irrigation channels. Each closure member is cantilevered by a semi-flexible arm from a frame that has a pivot point lying in a plane substantially coincident with the plane of the sealing surface of the valve. A pneumatic bellows, which may be remotely controlled, exerts pressure to close the closure member against the sealing surface of the wall about the port. An adjustable limit stop fixes the degree of opening of the closure member as it swings arcuately away from the valve port to open. A manual control lever with an adjustable limit stop and an over-center locking arrangement replaces or supplements the pneumatic closure arrangement.

11 Claims, 12 Drawing Figures

FIG. 7.
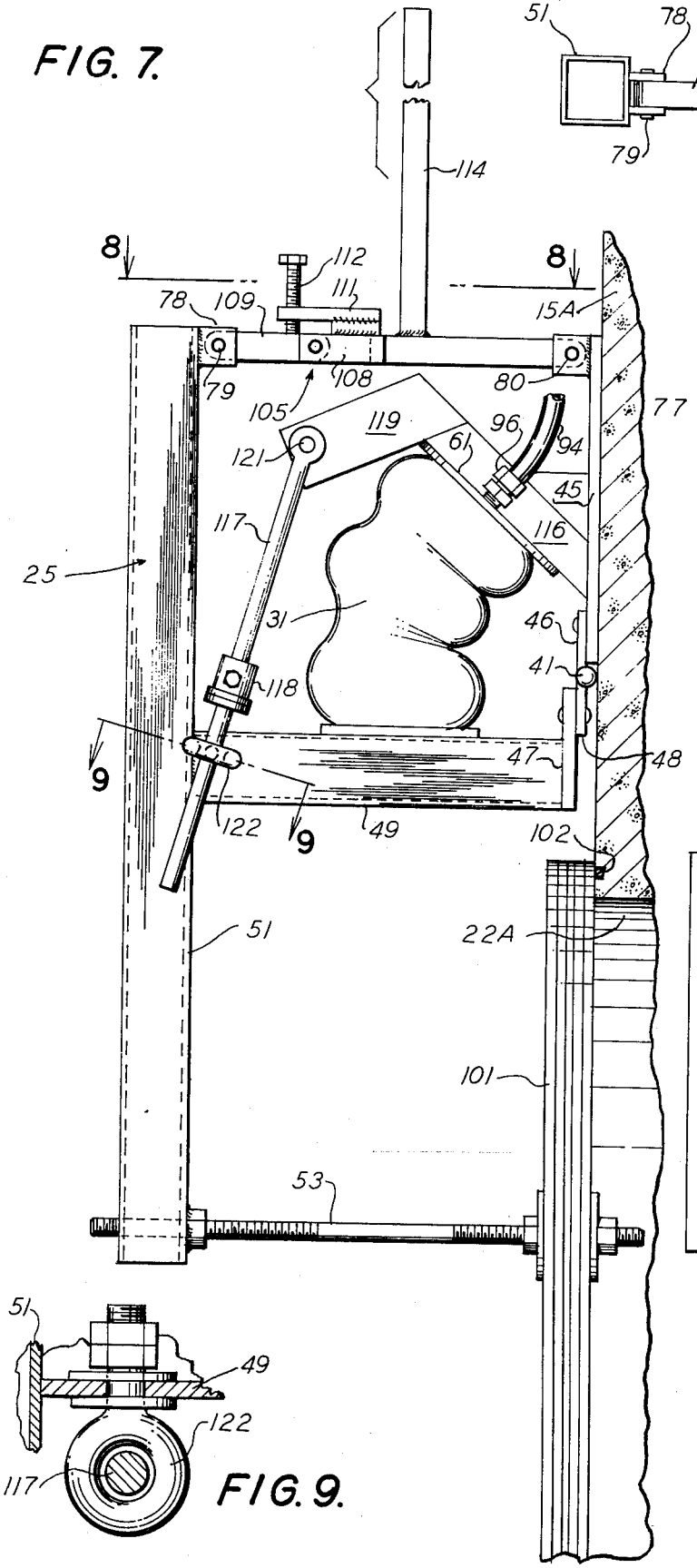
FIG. 8.
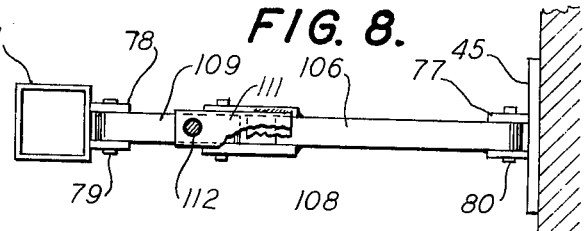
FIG. 10.
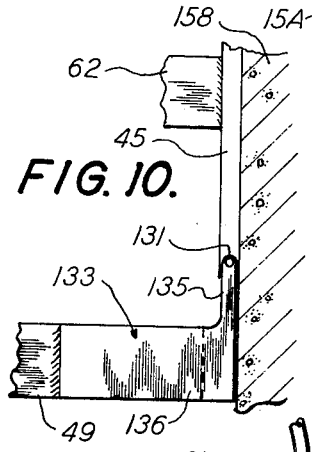
FIG. 11.
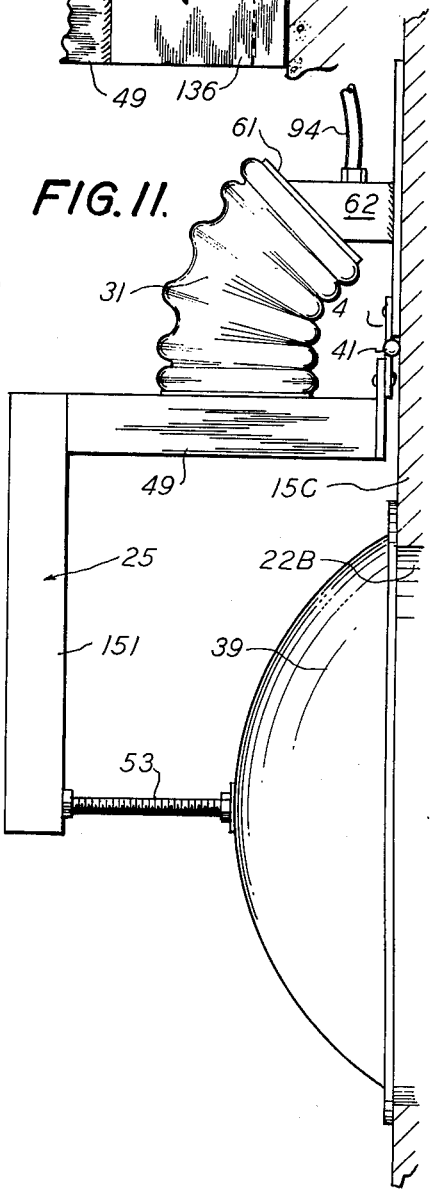
FIG. 9.

DISTRIBUTION VALVE FOR IRRIGATION CHANNELS

BACKGROUND OF THE INVENTION

The invention relates to irrigation valves and more particularly to large capacity valves for controlling water distributed from terminal irrigation channels to agricultural fields. Customarily such valves have been sliding or gate types, since the multiplicity of valves needed in a large field precludes use of conventional cast metal line valves. The distirbution of water from the main or terminal irrigation channel is subject to several variables, including the type of crop to be watered, the season, soil porosity, rainfall and field grade or slope. It is usual for the water to be discharged from the irrigation channel through the channel wall into several spaced water spreading and velocity limiting structures to minimize erosion at the point of water entry to the field.

The number of distribution ports is an optimum arrived at by considering the amount of water desired for the field at a given time in view of the field's absorbsion factors and the volume of flow in the channel, the desirability of having as few primary or terminal channels as possible crossing the fields, the inclination of the agricultural surface and the porosity of the soil. The present invention provides a distribution valve that is not only inexpensive to fabricate, but that is also capable of controlling large volumes of water at high pressures, is capable of diverting the emerging torrent to limit water velocity, and that is capable of either remotely controlled pneumatic operation or in situ manual operation.

BRIEF STATEMENT OF THE INVENTION

The invention contemplates, in a walled irrigation channel having ported side walls, the combination which comprises a preferably domed valving closure member with a resilient rim cantilevered with some degree of flexibility on an adjustable thrust rod which is supported by a frame, which frame is pivoted from a hinge mounted to the side wall of the irrigation channel adjacent a valve opening or port, such that the pivot line of the hinge lies substantially in the plane of the sealing surface about the port.

Preferably a fluid powered actuator such as a bellows, a diaphragm or a cylinder is fixed at one end with respect to the side wall and expandable upon actuation to move the frame and the valving member into closing position against the side wall about the valve port therein. The actuator is preferably remotely controllable and a series of water valves may be controlled or actuated from a single control point remote from all the valves.

A preferred embodiment of the invention includes a manual arm articulated to the frame to afford on the site manipulation of the valve closure member by personnel traveling the channel wall. The arm or lever may be secured to pivoted linkage fixed to the side wall and to the support frame for the valving member. The linkage may be in the form of a yoke through which a pivoted threaded member extends in a tube which is in turn pivotably secured in the yoke. The threaded member carries a stop adjustable along its length adjacent the tube to register against the tube and thereby limit the opening displacement of the valving member from the port, as the manual arm or lever is operated.

Similar limiting means on the opening arc of the valving member may be combined with the pneumatically operated embodiment as well.

These and other advantages of the invention are apparent from the following detailed description and drawing.

BRIEF DESCRIPTION OF THE DRAWING

FIG. 4 is a fragmentary sectional elevation similar to FIG. 2 but to a large scale;

FIG. 7 is a fragmentary sectional elevation of a further alternate embodiment of the invention;

FIG. 8 is a plan view thereof, partly broken away, taken along line 8 — 8 of FIG. 7;

FIG. 9 is a fragmentary sectional view taken along line 9 — 9 of FIG. 7;

FIG. 10 is a fragmentary elevational view of an alternate master hinge;

FIG. 11 is a fragmentary sectional elevation of a still further alternate embodiment of the invention employing only pneumatic control of the water port valve.

DESCRIPTION OF THE PREFERRED EMBODIMENTS

Figure 1:
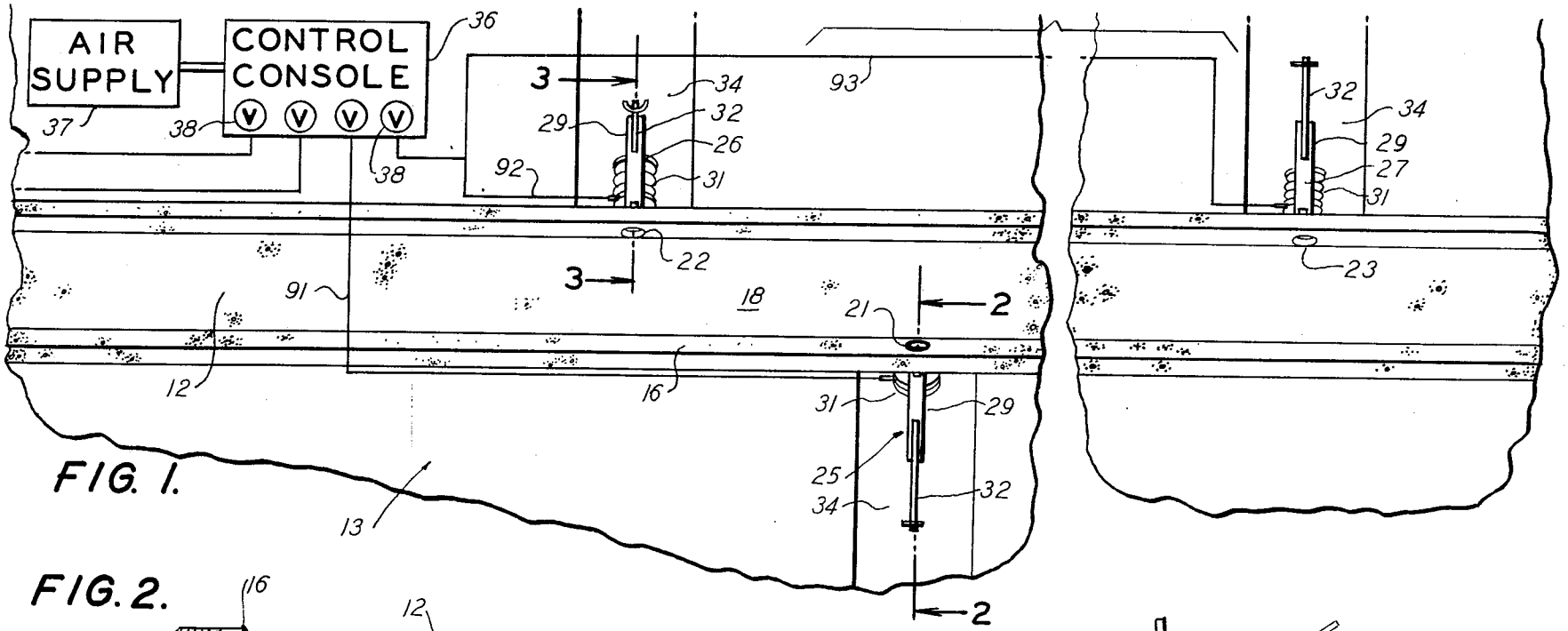
FIG. 1 is a schematic fragmentary plan view of a pneumatically controlled irrigation system employing the valve of the invention.
Figure 2:
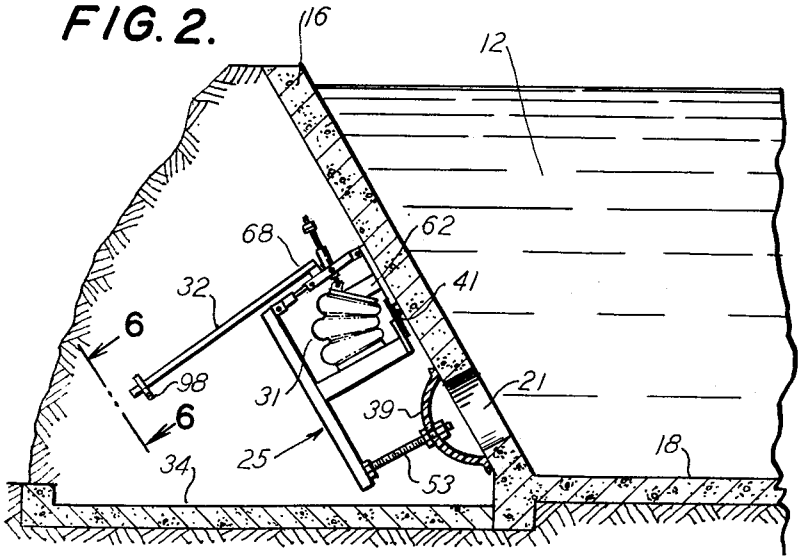
FIG. 2 is a sectional elevation taken along line 2 — 2 of FIG. 1.
Figure 3:
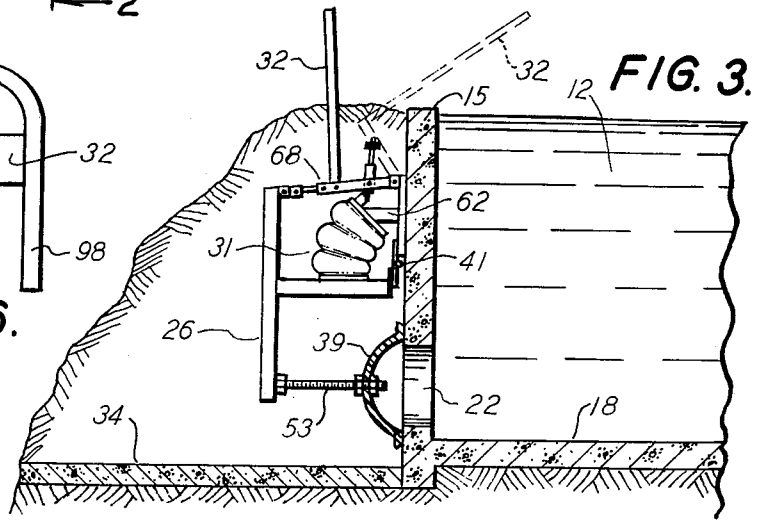
FIG. 3 is a sectional elevational view of an alternate installation of the inventive valve, taken along a line similar to line 3 — 3 of FIG. 1.
Figure 6:
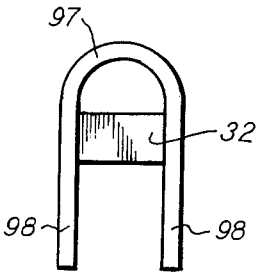
FIG. 6 is a detail end view of a control handle taken along line 6 — 6 of FIG. 2.

In FIG. 1 a terminal irrigation channel 12 traverses an agricultural field 13. The channel has spaced parallel walls 15, 16 and a bottom wall 18, all of which are conventionally of poured concrete. The walls 15, 16 are shown in FIG. 2 as sloping vertically and in FIG. 3 as substantially perpendicular to the bottom wall 18. Walls 15, 16 have ports 21, 22, 23 visible in FIG. 1 near the bottom of the channel.

At each port is a valving assembly 25, 26, 27 respectively. Each assembly has an actuating frame 29, a locking bellows 31 and a manual control lever 32. Each port discharges into a shallow trough 34 conventionally teminating away from the port in a transverse basin (not shown) which aids in redirecting the water flow.

Each bellows is supplied air through a control console 36 from a supply 37 of air under pressure. A plurality of valves 38 at the console may be individually opened to cause expansion of the bellows, which closes a particular port valve member like member 39 at each port. While the schematic drawing of FIG. 1 shows each bellows to be controlled by a single console valve separately, a plurality of bellows may be joined in parallel to a single valve 38 such that the manipulation of a single console valve controls the opening or closing of several valving members 39 at the channel wall ports.

The manual levers 32 are such that the frame may be latched to hold the valving member closed against the wall surface around the port to guard against inadvertent opening of the valve members because of accidental air pressure loss. The unlatched position of frame lever 32 shown in dotted lines in FIG. 3 allows frame 26 to revolve about a master pivot 41 and remove valving member 39 arcuately away from port 22 such that water flows from the channel into trough 34 and thence over a broad front into the field 13.

Figure 5:
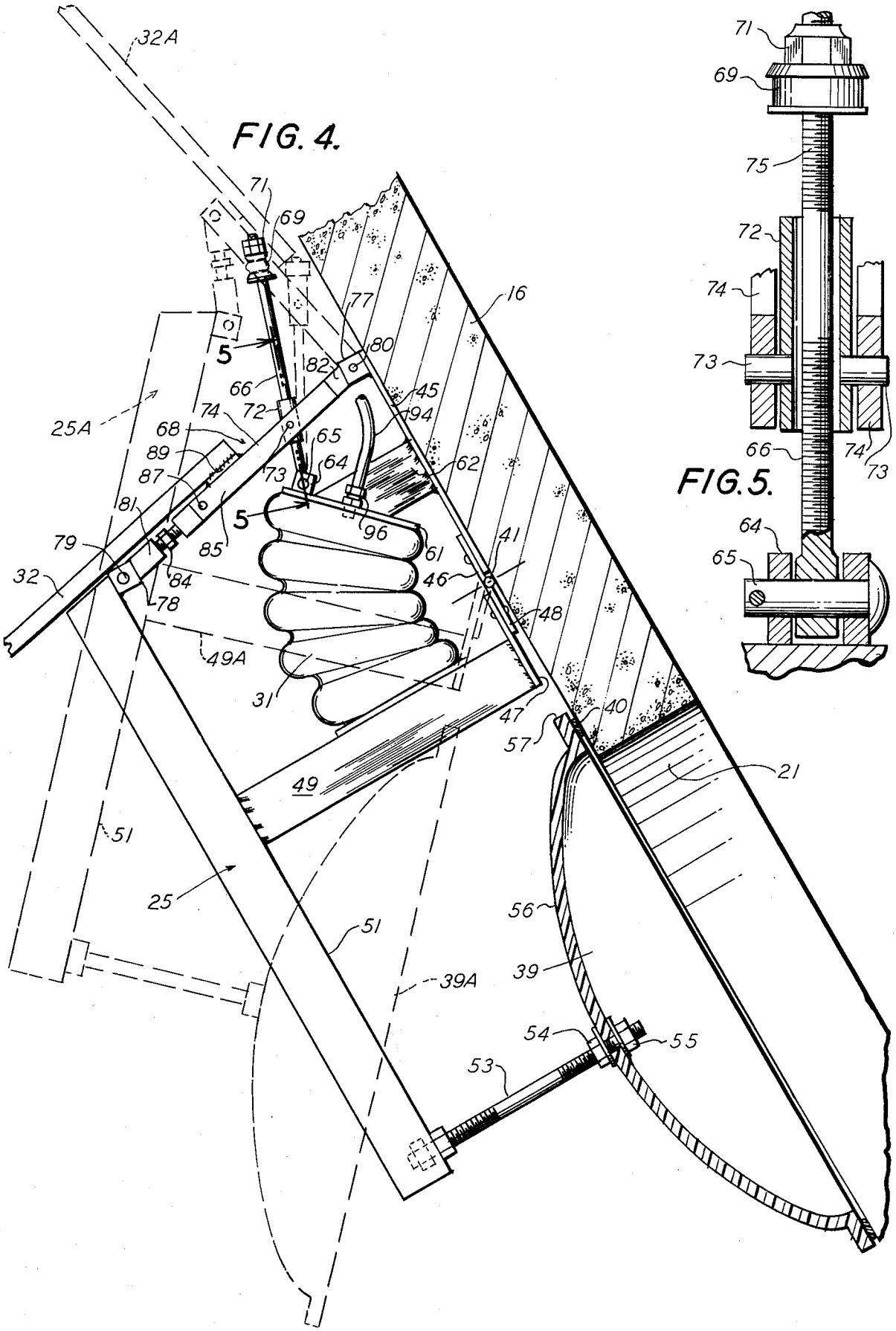
FIG. 5 is a sectional view taken along line 5 — 5 of FIG. 4.

The valve is shown in more detail in FIGS. 4 and 5. A fastening plate 45 (FIG. 4) conventionally fixed to an outer face of wall 16 has a hinge 46 containing master pivot 41. As can be seen from FIG. 4, the pivot line is close to the plane of the outer wall to provide substantially perpendicular motion of member 39 when it contacts the outer face of wall 16. Skidding motions and shearing forces in the plane of contact of a gasket 40 and wall 16 are thus reduced for maximum sealing effectiveness and longest life. An extension 47 of a leaf hinge 48 is fixed to a post 49 extending away from wall 16. A beam 51 is fixed near its middle at right angles to the post. A threaded cantilever rod 53 secured at one end of beam 51 extends to support domed valving member 39, which may be fixed to the rod by opposed nuts 54, 55. The valving member has a domed section 56 and an annular rim 57. Sealing gasket 40, fixed to rim 57, contacts the outer wall surface about the port when member 39 closes against wall 16, sealing the port when the bellows inflates It has been found that the average terminal channel with an eighteen inch diameter opening needs a closing force of about 400 pounds to overcome the hydrostatic pressure. An added force of 400 pounds is needed to effect a good seal between gasket 40 and the normally uneven surface of concrete wall 16 about port 21. The post 49 and beam 51, and the operating air pressure at the bellows of the illustrative embodiment are designed to give a closing force of about 800 pounds against the exemplary domed valving member.

Once the sealing air pressure is reduced sufficiently by manipulating a valve 38 at the console, or by releasing the latch by means of frame lever 32, the outflow of water through opening 21 is sufficient to retract member 39 and frame 25 to the dotted positions 39A and 25A of FIG. 4. The dotted indication 32A shows the unlocking position of the frame lever. It can be appreciated from the broken lines indication of post 49A that the bellows 31 is considerably collapsed in the extreme position of retraction shown between post position 49A and a bellows mounting plate 61 on a pedestal 62 extending outwardly from the wall and fastening plate 45.

It is desirable to limit the swing of the valving member away from port 21 and also the movement of frame 25. Therefore the bellows mounting plate 61 has an outward bracket 64 by means of which a pivot pin 65 secures a limit rod 66 to the mounting plate. The limit rod extends away from the mounting plate through the toggle assembly 68 of manual frame lever 32 to a resilient stop 69 secured on the limit rod by suitable fasteners 71. The rod is free to reciprocate within a guide bushing 72 pivotably mounted by pins 73 in parallel straps 74 of the toggle assembly. The limit rod has threads 75 such that the position of resilient stop 69 may be adjusted as desired to thus limit the retraction of the valving member and frame 25.

The toggle assembly 68 of which frame lever 32 is a part extends between a pivot bracket 77 on plate 45 and a similar bracket 78 on beam 51. Pins 79, 80 through each bracket hold a pivot arm 81 at the beam bracket and a pivot arm 82 at the plate bracket. Arm 81 threadably engages an adjustment stud 84 which is in turn threaded into a pivot bar 85 at that end of straps 74 remote from bracket 77 on the plate 45. Adjustment of the stud changes the holding force of the toggle assembly 68 by varying the space between pivot 79 and a pin 87 through the straps 74 and bar 85. The frame lever is fixed to the straps by an intermediate bridge 89 secured to both straps and the lever as by welding, for example. Motion of the lever turns the straps about pivot 80, resulting in a hinge action of the assembly about pin 87, moving the frame to allow the bellows to collapse when air pressure is reduced or removed.

Adjustment of closing pressure of the valving member is also achieved by linear movement of the domed member along cantilever 53 to assure that "lockup" of the toggle and sealing of the member occur at the same time.

Air is conducted from the console 36 to each bellows through conventional air lines shown schematically at 91, 92 and 93 in FIG. 1 and as conduit 94 in FIG. 4. The conduit supplies the bellows by way of a connector 96 passing through mounting plate 61 to the interior of the bellows. The same line may act to exhaust the bellows when a valve 38 is reversed.

In operation, the system of FIGS. 1–5 responds to air pressure from the control console 36 to expand each bellows to which air is supplied, thus moving frame 25 and its valving member 39 across an associated port 21 to close the port. Air pressure may continue to hold the port sealed, or frame lever 32 may be positioned to lock toggle assembly 68, securing the valve in closed position without regard to air pressure changes.

If the frame lever is not latched, the valve ports 21 may be opened to supply water to the field in selected areas by manipulation of the valves 38 at the control console.

As can be seen from FIG. 4, the open position of the valving member places the domed member as a baffle to water pouring from port 21. The baffle effect is an added deterrent to a concentrated stream flow which might result in damaging soil erosion in the immediate area of the port. The retraction path of the valving member is thus made to achieve a secondary benefit.

It has been found helpful to provide means on each frame lever for engagement with a tool carried by channel workers, usually a shovel (not shown). Either the shovel point may be engaged with a loop 97 of an engagement U fixed to the free end of the lever, or the step of a shovel blade may be engaged with the extending legs 98 of the U to enable the lever to be manipulated from the wall. by a worker traversing the channel 12 thereon.

In FIGS. 7 – 9 an alternate embodiment of the invention is also capable of response to either central or in situ control. A channel wall 15A has a port 22A which may be 16 – 18 inches in diameter. The closing forces for a valving member 101 shown closed against the port are therefore commensurate with those forces previously discussed.

The valving member of the embodiment of FIG. 7 is a flat disc of laminated wood, or other rigid material of some thickness, such as an inch. A threaded cantilever 53 supports the member from a beam 51, which may be steel tubing.

The beam is joined intermediately to a post 49 which extends from a hinge extension 47 fixed to a hinge leaf 48 of a hinge 46. The hinge itself has a pivot pin which defines a master pivot 41 for the frame of which the beam and post are a part. The hinge pivot lies close to the surface of the wall against which the valving member seats. An annular seal 102 which may be recessed in the wall surfce about the port serves to insure complete closure of the port when compressed by the valving member. The path of the member 101 is arcuate toward and away from the port about the master pivot, and it therefore assumes an open position which is also a baffle position for the emerging water stream from the port.

A toggle assembly 105 extends between brackets 77 at the wall and 78 at the beam. Bracket 77 is fixed to a mounting plate 45 conventionally secured to the wall exterior. The assembly comprises a pivot bar 106 pivotably secured to bracket 77 by a pin 80, spaced straps 108 extending the reach of the bar and fixed thereto, and a short pivot bar 109 pivoted in bracket 78 by a pin 79 and additionally pivotably secured to the spaced straps, all of the pivot pins being substantially aligned when the toggle is latched.

As can be seen from FIG. 7, a bridge block 111 fixed to the straps receives a set screw 112 which in proper retracted position allows toggle latching during manual operation. Conversely, proper advancement toward short pivot bar 109 prevents inadvertent toggle latching while the valve is being operated automatically. Manual release is by means of a manual frame lever 114 extending at right angles to the toggle assembly toward the top of channel wall 15A. The lever angle is adapted to the wall pitch to make its operative end more accessible to workers on the terminals channel wall.

A bellows 31 is secured between post 49 and a mounting plate 61 supported on an angled pedestal 116 that extends upwardly and outwardly from plate 45 on the wall. An air supply conduit 94 secured in a connector 96 in the bellows mounting plate supplies air under pressure to the bellows from the control console.

As in the previously described embodiment it is desired to limit the retraction of the valving member and the collapse of the bellows. Therefore, a limit rod 117 is provided, with a resilient stop 118 adjustably mounted thereon. One end of the limit rod has an eye secured for arcuate movement to an extending arm 119 of pedestal 116 by a pin 121. The other end of the limit rod passes through an eye bolt 122 secured to the post near the beam by a nut on its threaded shank, securing being done prior to joining the post and the beam. The rod is free in the eye bolt 122 (see FIG. 9).

As seen in FIG. 7, air pressure has expanded the bellows and the frame is swung around master pivot 41 such that the valving member is closed over port 22A. The toggle is unlatched, and when air is released from the bellows, the frame is pushed away from the wall by water pressure at the port on the valving member. The eye bolt then progresses along the limit rod until arrested by the resilient stop, halting retraction of the frame and setting the valving member in baffle position, as described with respect to the previously set forth embodiment.

FIG. 10 shows fragmentarily an embodiment of the invention utilizing a special hinge element. A mounting plate 45 on a vertical channel wall 15B supports a bellows pedestal 62. A pin 131 in an end of the mounting plate, and parallel to the surface of the wall, hingedly supports a spaced pair of arms like arm 133, the pin 131 defining a master pivot like pivot 41 of previously set forth embodiments, approximately in the plane of the sealing surface of the port (not shown). Each arm has a hinge limb 135 and a carrier portion 136. The pin engages the hinge limbs. The carrier portions are fixed to a post 49 of a frame similar to the frame 25 of the embodiment of FIG. 4, such that the frame and its valving member (not shown) swing about the master pivot. By piercing the plate 45 for the hinge pin the pivot may be closer to the sealing surface plane than when the conventional hinge leaf is applied to the outer plate surface.

In FIG. 11 a channel wall 15C mounts a frame 25 carrying a domed valving member 39 on a relatively resilient cantilever 53, the cantilever extending from a beam 151 fixed at right angles to a post 49. The post is hinged to the mounting plate by a hinge 47 having a hinge pivot 41. A bellows 31 is fixed between post 49 and a mounting plate 61 on a pedestal 62. An air conduit 94 supplies air under pressure to the bellows from a console similar to the previously described console 36. The valving member closes a port 22B in the wall 15C.

The bellows is responsive to the condition of an air valve (not shown) at the control console, expanding when air flows from the valve. It contracts or collapses when air pressure is reduced. The bellows condition determines the position of the valving member with respect to the port. Since the bellows condition is controlled from the console, the valving of port 22B is solely remotely controlled.

In each of the described embodiments remote valving control is afforded. In some embodiments remote control may be deterred. Loss of air need not result in unwanted water flow when a toggle assembly is combined with remote actuation for latching the valve closed. The embodiment of FIG. 12 is one that is pneumatically controlled, preferably from a remote point, and differs from previously described embodiments in being operative within the confines of the terminal channel, although operative to open and close a port in the channel wall also.

Figure 12:
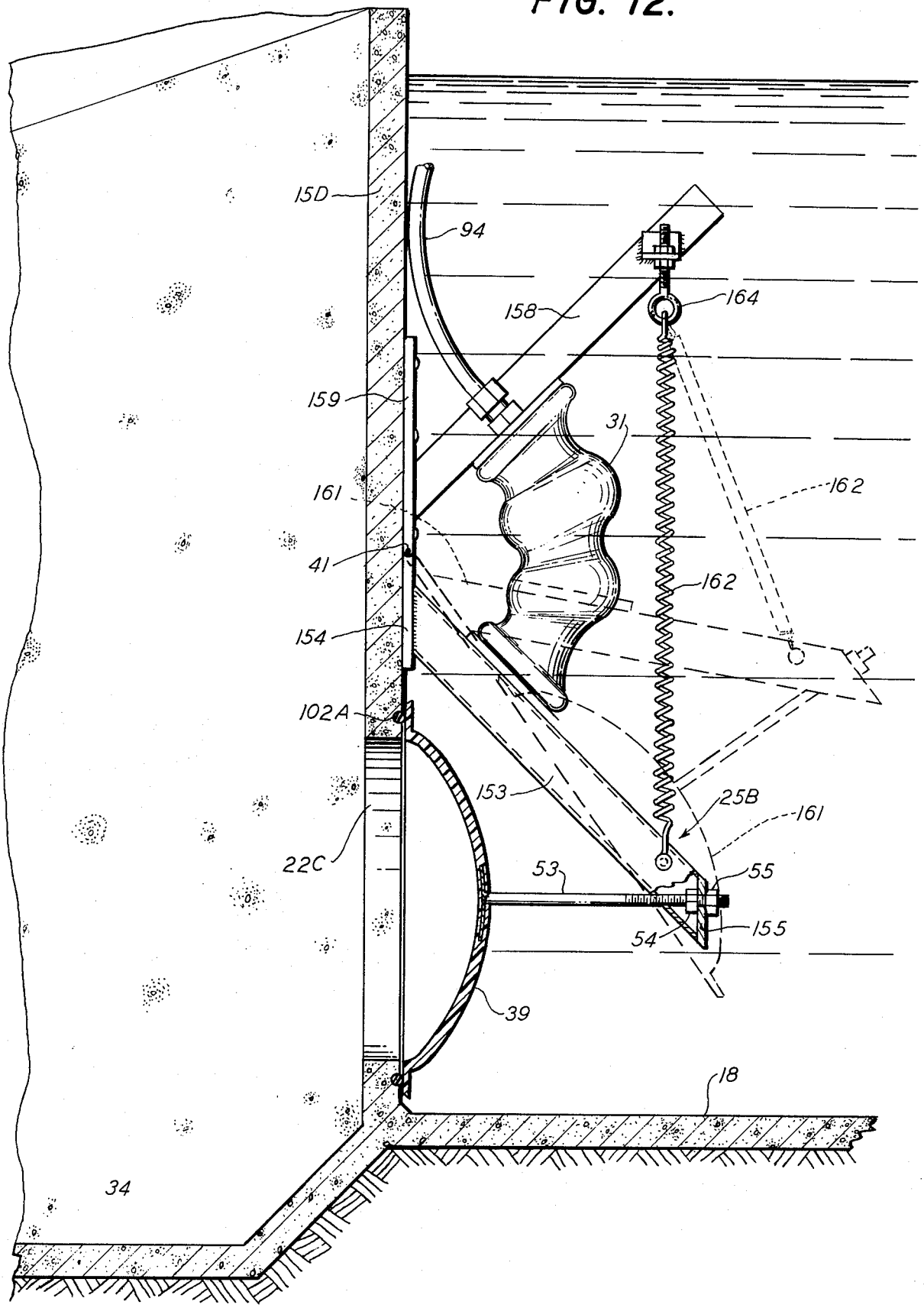
FIG. 12 is a fragmentary sectional elevation of a further alternate embodiment wherein the valving member is in the channel.

As seen in FIG. 12, a terminal channel has a bottom wall 18, side walls like wall 15D and a discharge trough with a wall 34. Wall 15D has a port 22C near the juncture of the side wall and the bottom wall. A domed valving member 39 is closed against the surface about the port, sealing against a resilient ring 102A seated in the wall. An elongate cantilever 53 supports the valving member from a frame 25B which is hinged at master pivot 41 adjacent interior surface 161 of wall 15D. The frame comprises a beam 153 fixed to a hinge leaf 154 and having a terminal plate 155 from which the cantilever extends to the valving member. Nuts 54, 55 secure the cantilever to the terminal plate.

The beam extends at an angle from the wall 15D, downwardly and outwardly toward intersection with the horizontal axis of the port. A bellows pedestal 158 extends upwardly and outwardly from an end fixed to a mounting plate 159 conventionally secured to the wall. The mounting plate also supports the hinge leaf 154 and master pivot 41.

A bellows 31 similar to those described with respect to previous embodiments is fixed between the pedestal and the beam at points thereon such that the expansion and contraction path of the bellows is somewhat centered about the master pivot at a distance therefrom. An air conduit 94 connects to a control console (not shown) like the console 36 of FIG. 1 and actuates the bellows to move the frame to the closed position of FIG. 12. The open position is shown in broken lines at 161, wherein the valving member is displaced or retracted from the port 22C.

Since the valve of FIG. 12 operates within the channel, water flow at the port does not aid in opening the valving member, but rather, opposes opening. Therefore the embodiment of FIG. 12 combines an extension spring 162 with the other elements of the device to withdraw the valving member from the port to permit water to flow from the channel to the field. The spring is mounted at one end to beam 153 near the terminal plate 155 and extends to an eye bolt 164 secured adjustably in an angle mount 166 at the free end of bellows pedestal 158. Thus, when air pressure is reduced in the bellows to a sufficient degree, spring 162 retracts the valving member from port 22C, opening the port for water flow.

While several embodiments have been shown to illustrate the invention, the inventive scope is not thereby exhausted. Changes and modifications within the scope of the invention other than those shown will occur to those skilled in the particular art. It is therefore desired that the invention be measured by the appended claims rather than by the illustrative forms disclosed through this specification.

I claim:

1. In a walled irrigation channel having ported side walls the combination comprising a frame, hinge means supporting the frame adjacent a port, a valving member on the frame adapted to seal the port, a fluid powered actuator supported adjacent the wall and bearing on the frame, means remote from the port for supplying fluid under pressure to the actuator, and means for adjusting the position of the valving member with respect to the frame, said hinge means having a pivot point substantially coincident with the plane of closure of the valving member at the port.

2. Apparatus in accordance with claim 1 further comprising a toggle assembly releasably secured between the wall and the frame, means for adjusting the toggle assembly release load, and manual means for releasing the toggle assembly, said assembly when latched acting to preclude retraction of the valving member from closure at the port.

3. Apparatus in accordance with claim 2 wherein the means for adjusting the position of the valving member comprises a cantilever secured to the frame, a threaded portion on the cantilever, and threaded means for securing the valving member on the threaded portion.

4. Apparatus in accordance with claim 3 wherein the valving member comprises an hemispherical portion open to the port, a flat annulus integral with the hemispherical portion, and a sealing gasket on the annulus.

5. Apparatus in accordance with claim 3 wherein the valving member comprises a rigid disc, and a sealing gasket in the wall about the port.

6. Apparatus in accordance with claim 1 further comprising a post extending from the hinge means, a beam fixed at right angles to the post remote from the hinge means, said post and beam comprising said frame, and a pedestal fixed with respect to the wall and supporting said fluid powered actuator.

7. Apparatus in accordance with claim 1 wherein said means for adjusting the position of the valving member comprises a threaded cantilever fixed at one end to the frame and extending toward the port, said cantilever having some resilience, and members engaging the cantilever on each side of a wall of the valving member.

8. Apparatus in accordance with claim 1 further comprising a toggle assembly secured releasably between the frame and the wall, said assembly having three pivots for articulation of coupled members, an intervening adjustment portion between two pivots, and a frame lever fixed to a coupled member and extending therefrom toward the top of the channel wall.

9. Apparatus in accordance with claim 1 further comprising a limit rod pivotably fixed with respect to a fixed end of the fluid powered actuator, a guide member through which the rod passes pivotably secured to the frame, and a stop adjustably mounted on the rod to contact the guide member during movement of the frame to limit displacement thereof.

10. Apparatus in accordance with claim 9 wherein the guide member is pivotably secured to the toggle assembly.

11. Apparatus in accordance with claim 1 wherein the fluid powered actuator is an air bellows.

* * * * *